US010024625B2

(12) United States Patent
Cheng

(10) Patent No.: US 10,024,625 B2
(45) Date of Patent: Jul. 17, 2018

(54) ASSEMBLED ELECTRIC TOY GUN

(71) Applicant: KRISS INDUSTRIES ASIA LTD., Taipei (TW)

(72) Inventor: Li-Te Cheng, Taipei (TW)

(73) Assignee: KRISS INDUSTRIES ASIA LTD., Taipei (TW)

( * ) Notice: Subject to any disclaimer, the term of this patent is extended or adjusted under 35 U.S.C. 154(b) by 0 days.

(21) Appl. No.: 15/432,115

(22) Filed: Feb. 14, 2017

(65) Prior Publication Data

US 2017/0234644 A1 Aug. 17, 2017

(30) Foreign Application Priority Data

Feb. 17, 2016 (TW) ..... 105104531 A
Feb. 17, 2016 (TW) ..... 105104532 A
Feb. 17, 2016 (TW) ..... 105202239 U
Feb. 17, 2016 (TW) ..... 105202240 U
Feb. 17, 2016 (TW) ..... 105202241 U

(51) Int. Cl.
*F41B 11/642* (2013.01)
*F41B 11/646* (2013.01)
*F41B 11/71* (2013.01)
*F41B 11/73* (2013.01)

(52) U.S. Cl.
CPC ..... *F41B 11/642* (2013.01); *F41B 11/646* (2013.01); *F41B 11/71* (2013.01); *F41B 11/73* (2013.01)

(58) Field of Classification Search
CPC ..... F41B 11/642; F41B 11/646; F41B 11/71; F41B 11/73
USPC ..... 124/71, 60, 61, 63, 64, 65, 66, 67, 68, 124/72, 73, 77; 42/54, 55, 57, 58
See application file for complete search history.

(56) References Cited

U.S. PATENT DOCUMENTS 5,261,384 A * 11/1993 Hu ..... F41B 11/57 124/16
7,100,592 B1 * 9/2006 Yang ..... F41B 7/00 124/67
7,841,329 B2 * 11/2010 Yang ..... F41B 11/646 124/66
2003/0066096 A1 * 4/2003 Bryan ..... A23G 3/366 800/8

(Continued)

*Primary Examiner* — John Cooper
(74) *Attorney, Agent, or Firm* — Tim Tingkang Xia, Esq.; Locke Lord LLP

(57) ABSTRACT

Provided is an assembled electric toy gun that allows a spring in the toy gun to be changed quickly for altering projectile propulsion strength. The assembled electric toy gun has a positioning structure whereby a motor-end terminal and a battery-end terminal are mounted in place and disconnected quickly and efficiently. The assembled electric toy gun has a cylinder piston unit and a barrel which are aligned with different axial directions to thereby prevent the cylinder piston unit in operation from undergoing energy loss which might otherwise compromise the propulsion speed of a projectile. The assembled electric toy gun has a firing mode system which turns off a power converter whenever a trigger switch is in a suspension state, thereby saving the power of the toy gun. The assembled electric toy gun has a micro control unit connected to the power converter, thereby effectively reducing power loss.

20 Claims, 17 Drawing Sheets

(56) References Cited

U.S. PATENT DOCUMENTS

| | | | | |
|---|---|---|---|---|
| 2006/0231083 | A1* | 10/2006 | Tsurumoto | F41A 19/66<br>124/66 |
| 2007/0000483 | A1* | 1/2007 | Tsurumoto | F41A 17/36<br>124/73 |
| 2007/0101982 | A1* | 5/2007 | Ong | F41B 11/54<br>124/65 |
| 2008/0078369 | A1* | 4/2008 | Yeung | F41B 11/64<br>124/67 |
| 2008/0155875 | A1* | 7/2008 | Iwasawa | F41B 11/644<br>42/54 |
| 2010/0115816 | A1* | 5/2010 | Chu | F41B 11/57<br>42/54 |
| 2010/0326414 | A1* | 12/2010 | Maeda | F41B 11/51<br>124/74 |
| 2011/0214654 | A1* | 9/2011 | Lee | F16H 1/04<br>124/31 |
| 2014/0342635 | A1* | 11/2014 | Hu | F41B 11/71<br>446/484 |
| 2016/0116248 | A1* | 4/2016 | Cheng | F41B 11/57<br>124/16 |

* cited by examiner

ASSEMBLED ELECTRIC TOY GUN

CROSS REFERENCE

This non-provisional application claims priority from Taiwan Patent Application No. 105104531, 105104532, 105202240, 105202239 and 105202241 filed on Feb. 17, 2016, the content thereof is incorporated by reference herein.

BACKGROUND OF THE INVENTION

Field of the Invention

The present invention relates to electric toy guns and, more particularly, to an assembled electric toy gun which allows a spring therein to be changed quickly, allows a motor-end terminal connected with a battery-end terminal in place and disconnected quickly, enables a cylinder piston unit and a barrel to be aligned with different axial directions, so as to prevent energy loss which might otherwise compromise the propulsion speed of a projectile, and saves power effectively.

Description of the Prior Art

Electric toy guns are a common type of toy gun. Unlike a gas gun which uses a compressed gas as a source of projectile propelling power, an electric toy gun generates projectile propelling power by compressing air with a piston tube. A conventional electric toy gun comprises a receiver, a barrel, a cylinder, a piston tube and a spring. The piston tube slidably fitted inside the cylinder, and the spring disposed in the piston tube. A nozzle is disposed at the front end of the barrel and aimed at a projectile to be fired. A gear set is disposed at the rear end of the receiver and driven by an electric motor. When the projectile approaches the barrel, the gear set drives the nozzle to deliver the projectile into the barrel. When a gear rack disposed on the outer wall of the piston tube is driven by the gear set to move toward the rear end of the receiver, the space between the piston tube and the cylinder increases and thus admits ambient air. When the gear rack of the piston tube gets free of the meshing and driving engagement with the gear set, the piston tube is driven to move toward the front end of the receiver under an elasticity restoring force exerted by the spring and thus compress the admitted air between the piston tube and the cylinder such that the air is forcibly discharged from the barrel. Eventually, the projectile in the vicinity of the nozzle is ejected.

Laws on projectile velocity of electric toy guns vary from country to country. For example, the United States differs from Japan in safety regulations for projectile velocity of electric toy guns, and thus those electric toy guns which comply with the American regulations do not necessarily comply with the Japanese regulations. However, conventional electric toy guns do not come with any mechanism for adjusting projectile velocity. The only way that conventional electric toy guns can alter projectile velocity is to alter spring elasticity modulus. Specifically speaking, conventional electric toy guns are equipped with springs which differ in modulus of elasticity so that the piston tube can operate at different compression ratios, thereby effectuating projectile velocity which differ in magnitude. Therefore, manufacturers have to manufacture different types of electric toy guns in order to comply with safety regulations of countries which the electric toy guns are intended to be sold to. As a result, the prior art still has room for improvements, regarding its disadvantages as follows: a plethora of parts and components and types thereof, cost-ineffective design changes, and inconvenience caused to manufacturers and distributors because of the need to stockpile products of various safety specifications.

Last but not least, a bolt and a barrel of a conventional real gun are aligned with the same axial direction, so are a cylinder piston unit and a barrel of an electric toy gun in order for the electric toy gun to look like the real gun. Hence, a change in an exterior design of the electric toy gun always necessitates aligning the cylinder piston unit and the barrel with different axial directions, thereby rendering it necessary to redesign a feeding linkage structure.

SUMMARY OF THE INVENTION

In view of the aforesaid drawbacks of the prior art, including the difficulty in mounting and dismounting a motor-end terminal and a battery-end terminal, the inventor of the present invention carried out related research with a view to overcoming the aforesaid drawbacks and, after conducting experiments and making efforts repeatedly, came up with the present invention.

To overcome the aforesaid drawbacks of the prior art, the objective of the present invention is to provide an electric toy gun that allows a spring therein to be changed quickly, allows a motor-end terminal connected with a battery-end terminal in placed and disconnected quickly, enables a cylinder piston unit and a barrel to be aligned with different axial directions, and effectuates power saving.

In order to achieve the above and other objectives, the present invention provides an assembled electric toy gun, comprising an upper receiver, a lower receiver, a power module, a feeding linkage structure, and a firing mode system. The upper receiver has a battery and at least one posting unit. The battery is disposed in the upper receiver and supplies a power. The posting unit is a hollow-cored post. The at least one posting unit is disposed in the upper receiver. The at least one posting unit each comprises a height. The lower receiver has a motor, a barrel, a cylinder piston unit, and a quick-release-change spring structure. The lower receiver is connected to the upper receiver. The motor is disposed in the lower receiver. The barrel is disposed in the lower receiver. An angle is defined between the cylinder piston unit and the barrel. The quick-release-change spring structure is connected to the bottom of the lower receiver through a connecting element.

The power module further comprises a first PCB and a second PCB. The first PCB is electrically connected to the battery and comprises at least one mounting hole. The at least one mounting hole is of an inner diameter larger than the outer diameter of the at least one posting unit. The first PCB is of a thickness smaller than the height of the at least one posting unit. The at least one mounting hole of the first PCB fits around the at least one posting unit, respectively. A screw is penetratingly disposed through the inner wall of the at least one posting unit, thereby allowing the first PCB to be mounted inside the upper receiver. At least two terminal clips are disposed on the first PCB. The second PCB is electrically connected to the motor and has at least two terminals. The terminals are disposed on the lower receiver. When the lower receiver is connected to the upper receiver, the terminals are clamped by the terminal clips on the first PCB, thereby allowing the second PCB to be electrically connected to the first PCB.

The feeding linkage structure has a nozzle. The nozzle is adapted to abut against the projectile. The nozzle is connected to a transmission kit. The transmission kit and the cylinder piston unit are interlocked by a gear train. The firing mode system is disposed in the lower receiver. The firing mode system is connected to the battery through a trigger switch. The trigger switch is in one of a contact operation state and a break suspension state.

DETAILED DESCRIPTION OF THE EMBODIMENTS

To enable persons skilled in the art to understand the objective of the present invention, preferred embodiments of the present invention are illustrated with drawings and described below.

Figure 1:
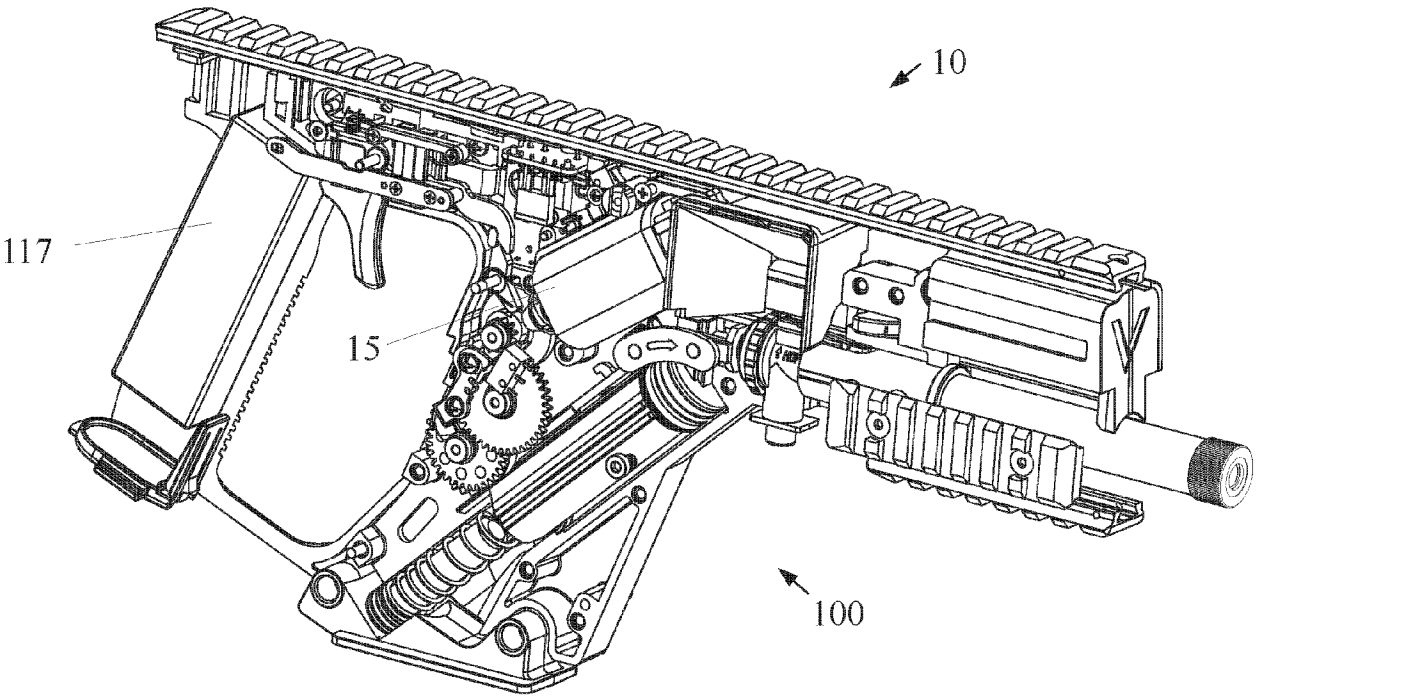
FIG. 1 is an assembly schematic view of a power module of the present invention.
Figure 2A:
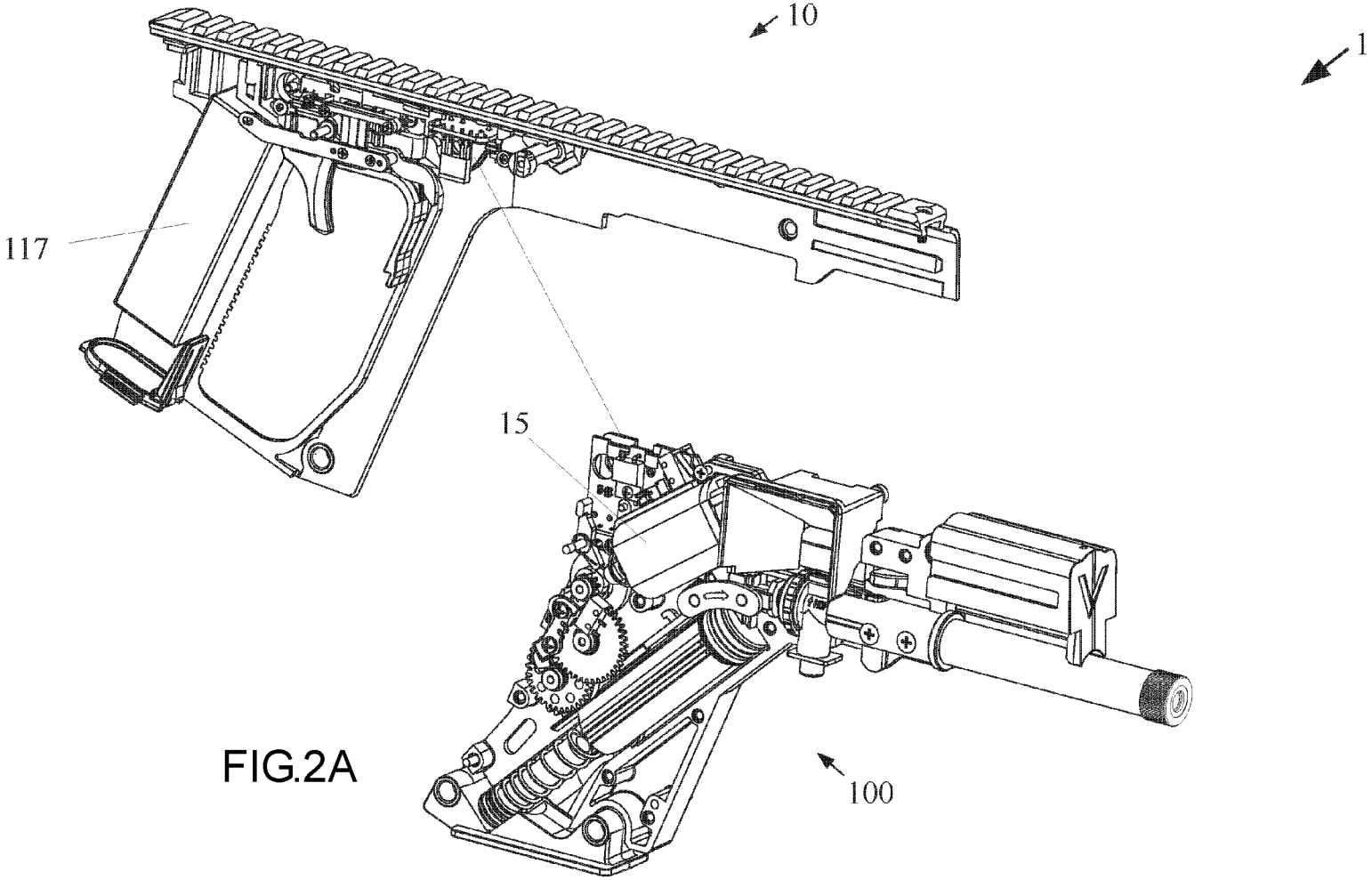
FIG. 2A is an exploded view of the power module of the present invention.
Figure 2B:
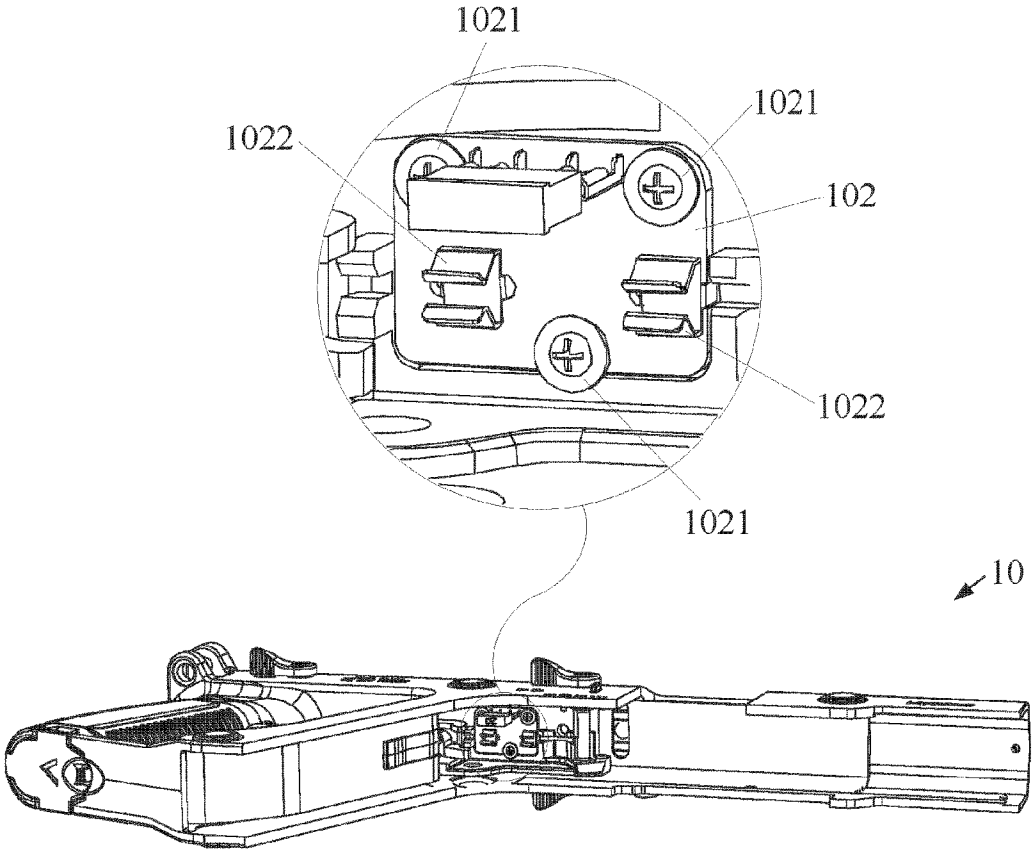
FIG. 2B is an enlarged view of a first PCB of the present invention.
Figure 2C:
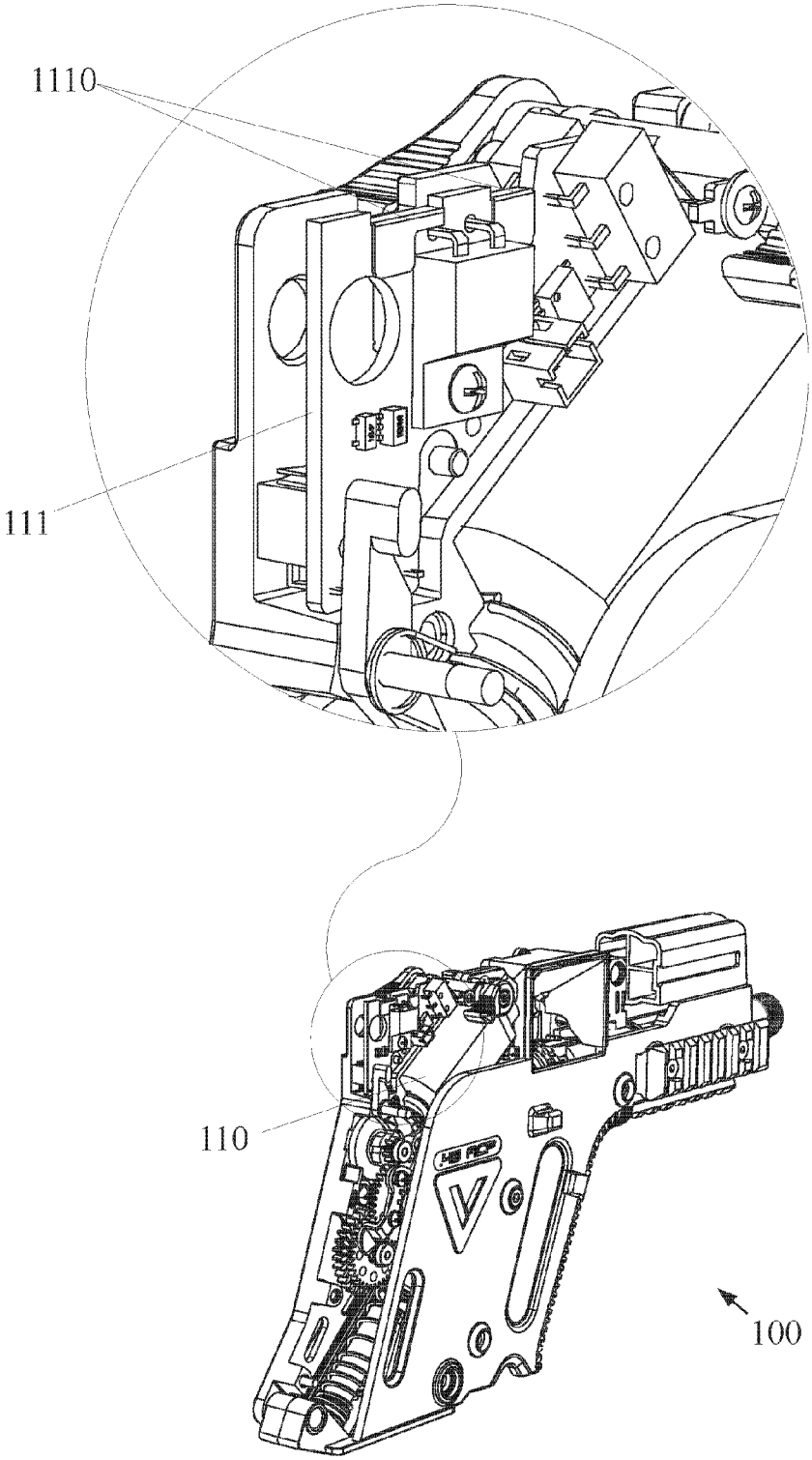
FIG. 2C is an enlarged view of a second PCB of the present invention.
Figure 2D:
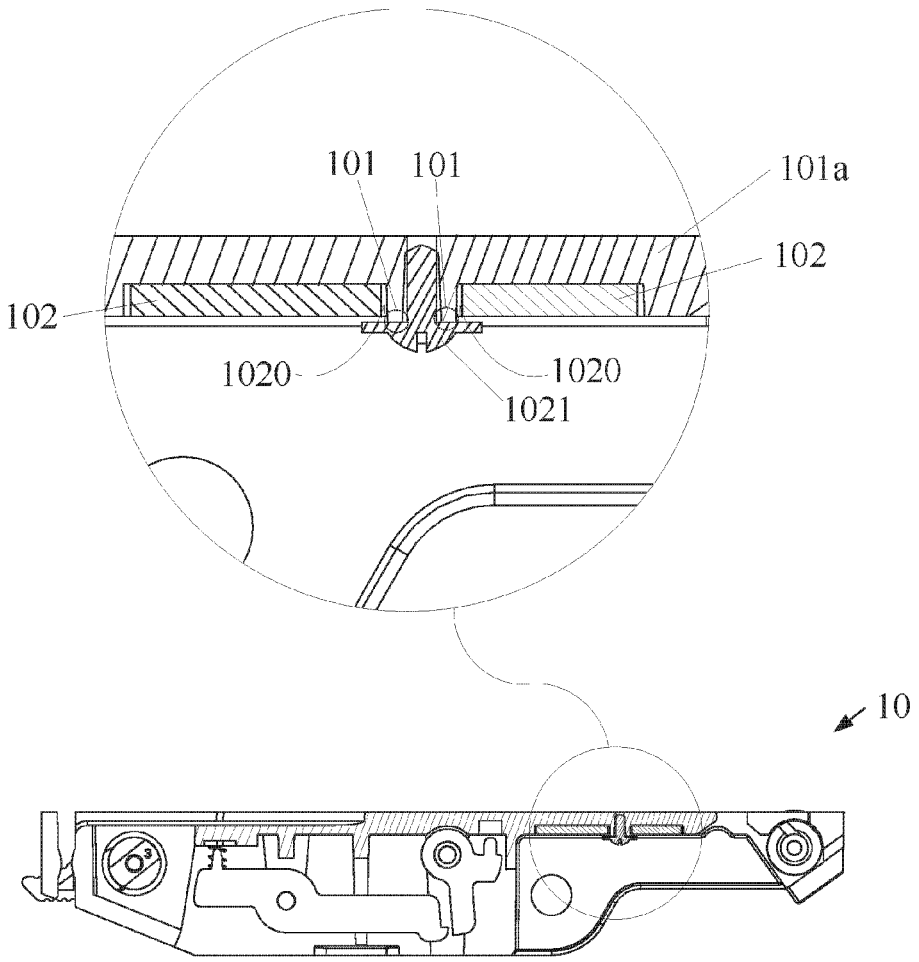
FIG. 2D is a schematic view of a posting unit of the present invention.

Referring to FIG. 1, according to the present invention, an assembled electric toy gun 1 comprises an upper receiver 10 and a lower receiver 100. Referring to FIG. 2A, FIG. 2B and FIG. 2D, the upper receiver 10 comprises a battery 117, at least one posting unit 101, and a first PCB 102. The battery 117 is disposed in the upper receiver 10 to supply a power. The at least one posting unit 101 is a hollow-cored post. The at least one posting unit 101 is disposed in the upper receiver 10. The at least one posting unit 101 is of a height each.

The first PCB 102 is electrically connected to the battery 117 and includes at least one mounting hole 1020 of an inner diameter larger than the outer diameter of the at least one posting unit 101. The first PCB 102 is of a thickness smaller than the height of the at least one posting unit 101. The at least one mounting hole 1020 fits around the at least one posting unit 101, respectively. A screw 1021 is penetratingly disposed through the inner wall of the at least one posting unit 101, thereby allowing the first PCB 102 to be mounted inside the upper receiver 10. At least two terminal clips 1022 are disposed on the first PCB 102. The at least one mounting hole 1020 looks circular or semicircular.

With the at least one mounting hole 1020 being of an inner diameter larger than the outer diameter of the at least one posting unit 101 and the first PCB 102 being of a thickness smaller than the height of the at least one posting unit 101, the first PCB 102 maintains resilience space on both a horizontal position and a vertical position even after the screw 1021 has been penetratingly disposed through the inner wall of the at least one posting unit 101 and the first PCB 102 has been mounted inside the upper receiver 10. Due to the resilience space on both a horizontal position and a vertical position, a motor-end terminal and a battery-end terminal, when aligned with and connected to each other, are not only mounted in place more easily but also exhibit a reduction in wear and tear of electrically conductive materials on the terminals, thereby allowing the terminals to exhibit high electrical conductivity even after multiple instances of assembly and disassembly.

Referring to FIG. 1, FIG. 2B, FIG. 2C and FIG. 2D, the lower receiver 100 is connected to the upper receiver 10. The lower receiver 100 comprises a motor 15 and a second PCB 111. The motor 15 is disposed in the lower receiver 100. The second PCB 111 is electrically connected to the motor 15 and has at least two terminals 1110. The terminals 1110 are disposed on the lower receiver 100. When the lower receiver 100 is connected to the upper receiver 10, the terminals 1110 are clamped by the terminal clips 1022 disposed on the first PCB 102, thereby allowing the second PCB 111 to be electrically connected to the first PCB 102.

In a preferred embodiment of the present invention, the at least one posting unit 101 is a hollow-cored post, and an internal thread is disposed on the inner wall of the post. The internal thread of the at least one posting unit 101 corresponds in position to an external thread of the screw 1021.

In another preferred embodiment of the present invention, the terminal clips 1022 are each inverted Ω-shaped and thus are effective in positioning the terminals 1110, thereby rendering it easy for a motor-end terminal and a battery-end terminal to be mounted in place and convenient for users to disconnect the motor-end terminal and the battery-end terminal.

In another preferred embodiment of the present invention, the at least one posting unit 101 is disposed on a base 101*a*, and the base 101*a* is connected to the upper receiver 10, but the present invention is not limited thereto. In another preferred embodiment of the present invention, the upper receiver 10 and the at least one posting unit 101 are integrally formed.

In yet another preferred embodiment of the present invention, the battery 117 is a lithium battery, a nickel-metal hydride battery or an alkaline battery.

In another preferred embodiment of the present invention, the at least one posting unit 101, the at least one mounting hole 1020 and the screws 1021 are in the number of three each, but the present invention is not limited thereto. In the other embodiments of the present invention, the at least one posting unit 101, the at least one mounting hole 1020 and the screws 1021 come in any other number each. Given the power module of the assembled electric toy gun of the present invention, a positioning structure enables the motor-end terminal and the battery-end terminal to be mounted in place quickly and efficiently and disconnected by users conveniently. Furthermore, since the first PCB 102 maintains resilience space on both a horizontal position and a vertical position, the motor-end terminal and the battery-end terminal, when aligned with and connected to each other, are not only mounted in place more easily but also exhibit a reduction in wear and tear of electrically conductive materials on the terminals, thereby allowing the terminals to exhibit high electrical conductivity even after multiple instances of assembly and disassembly.

Figure 3A:
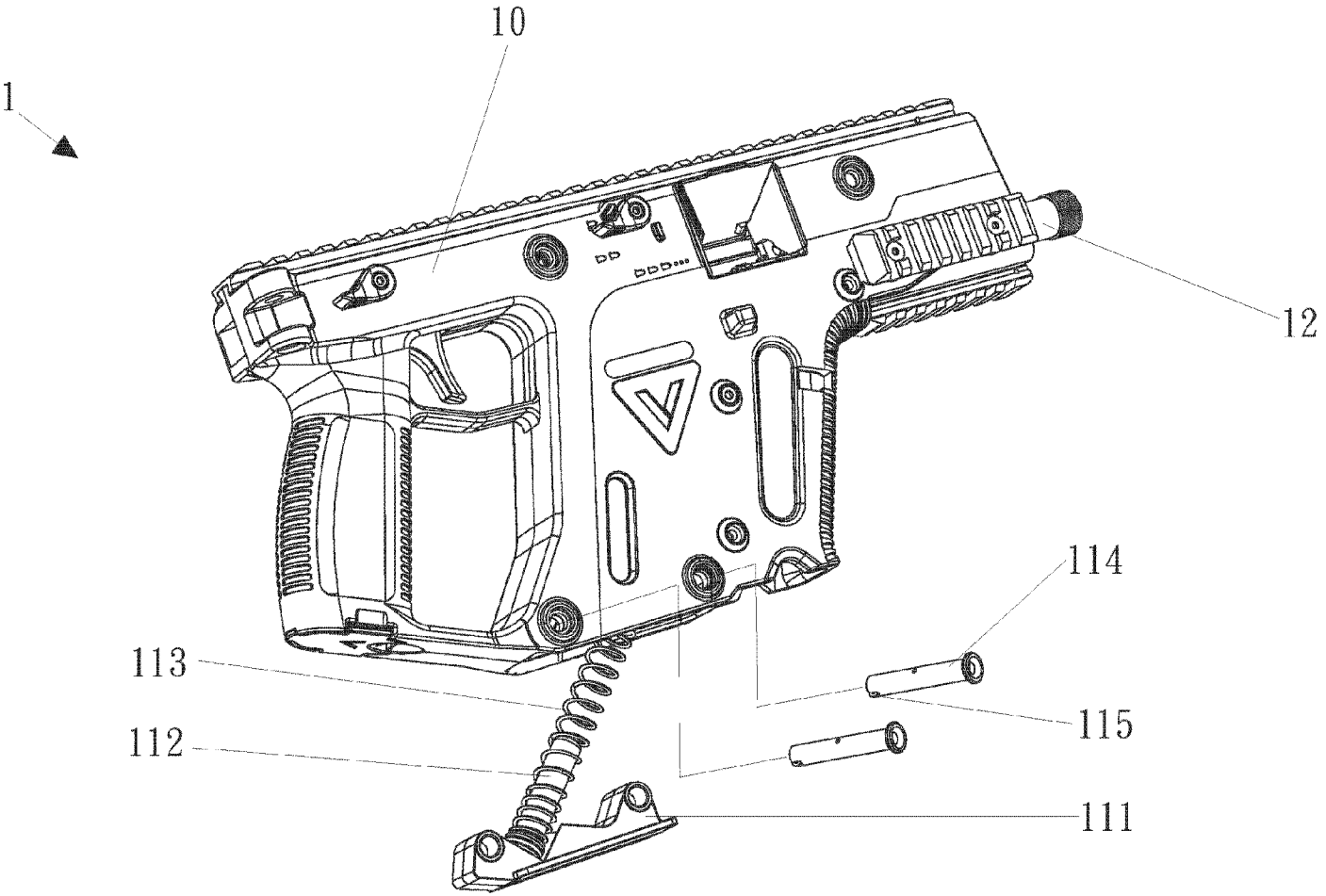
FIG. 3A is a structural schematic view of a quick-release-change spring structure according to an embodiment of the present invention.
Figure 3B:
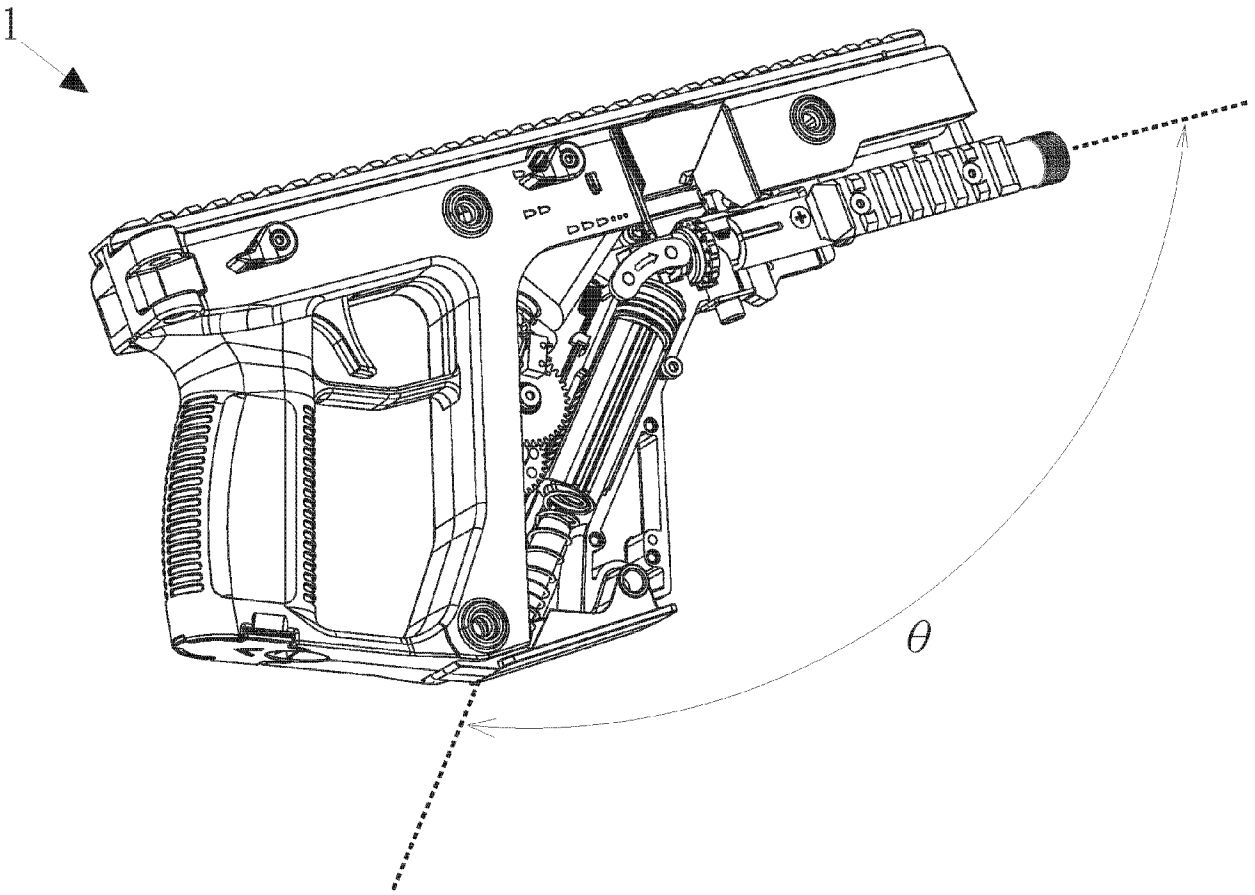
FIG. 3B is a perspective view of the quick-release-change spring structure according to an embodiment of the present invention.
Figure 3C:
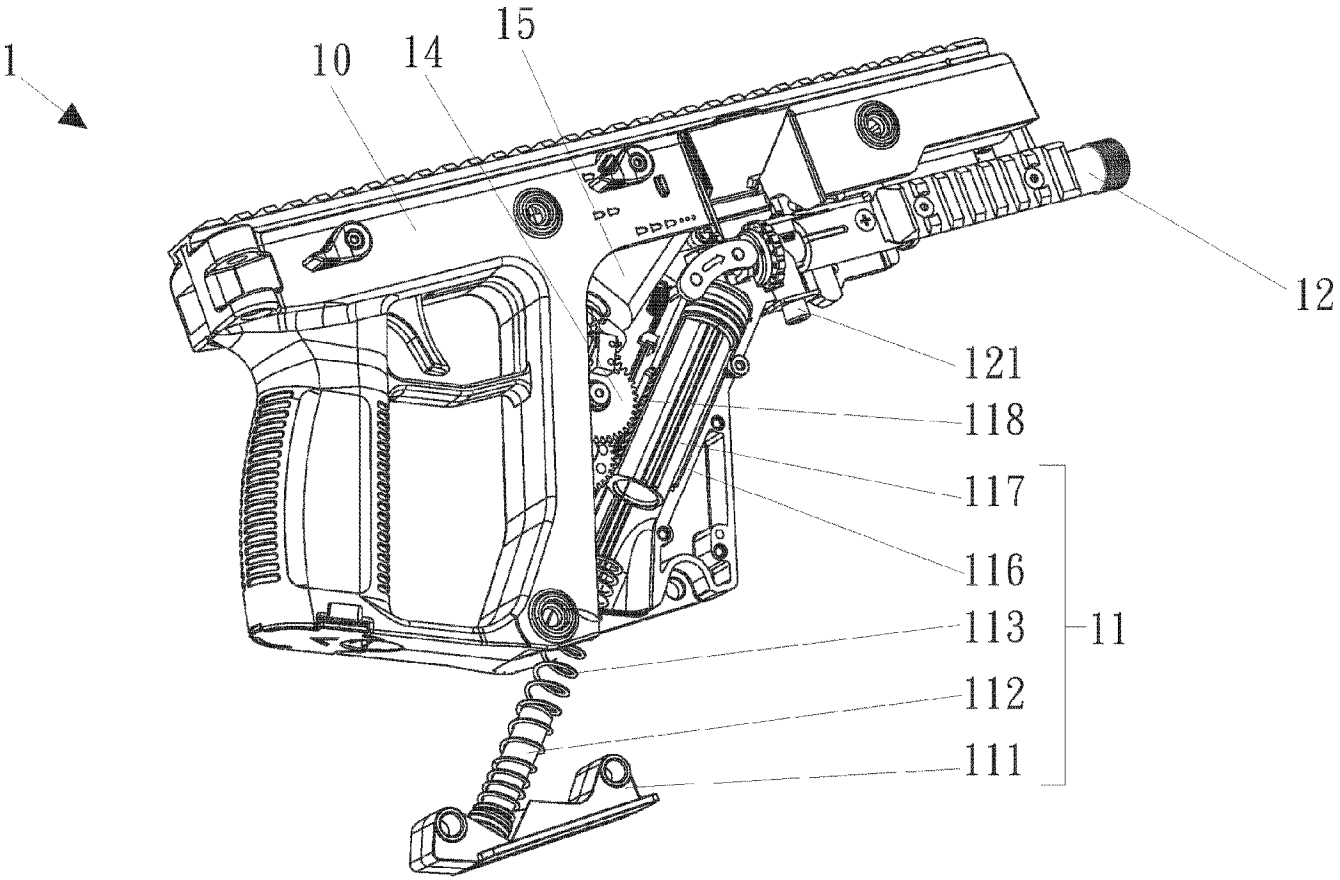
FIG. 3C is another perspective view of the quick-release-change spring structure according to an embodiment of the present invention.
Figure 3D:
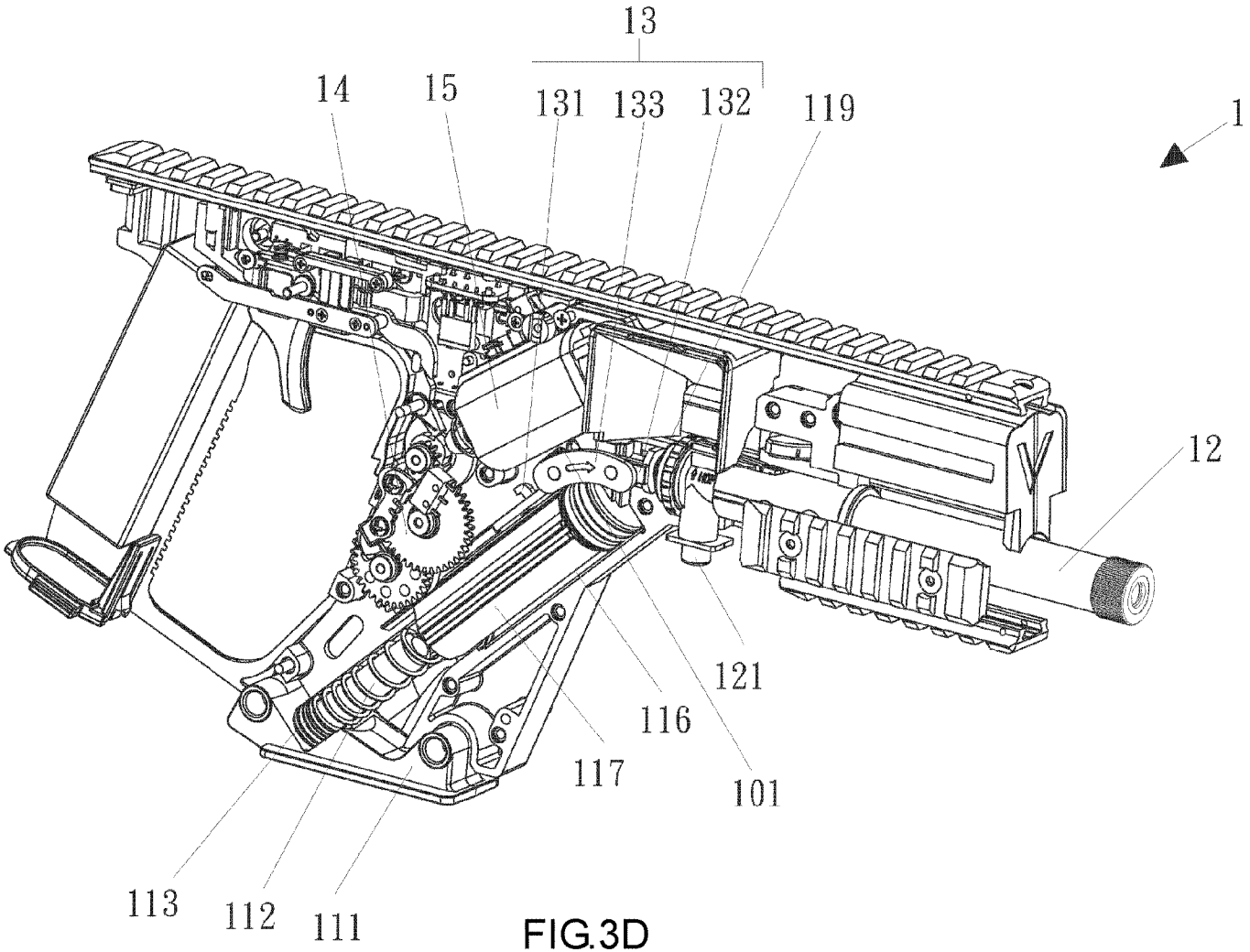
FIG. 3D is a perspective view of a feeding linkage structure according to an embodiment of the present invention.
Figure 3E:
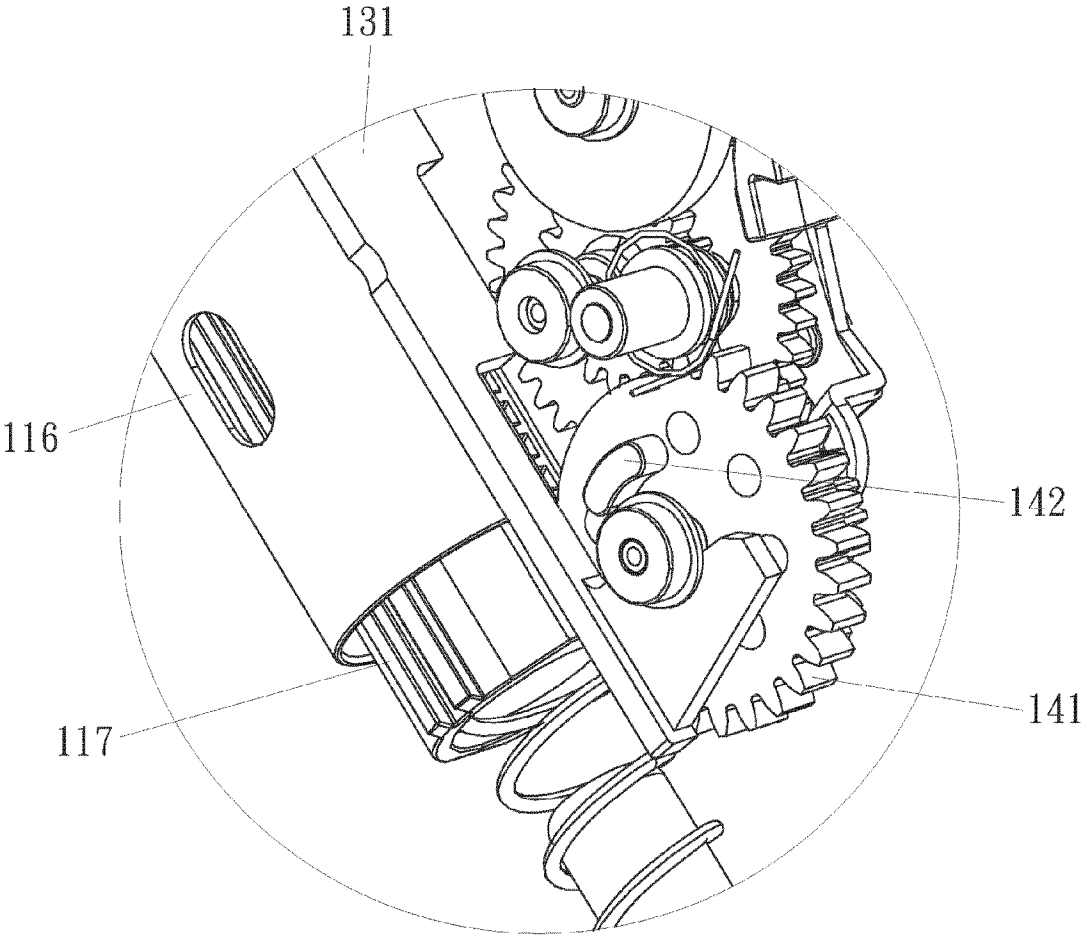
FIG. 3E is a partial enlarged perspective view of the feeding linkage structure taken from another angle of view according to an embodiment of the present invention.
Figure 3F:
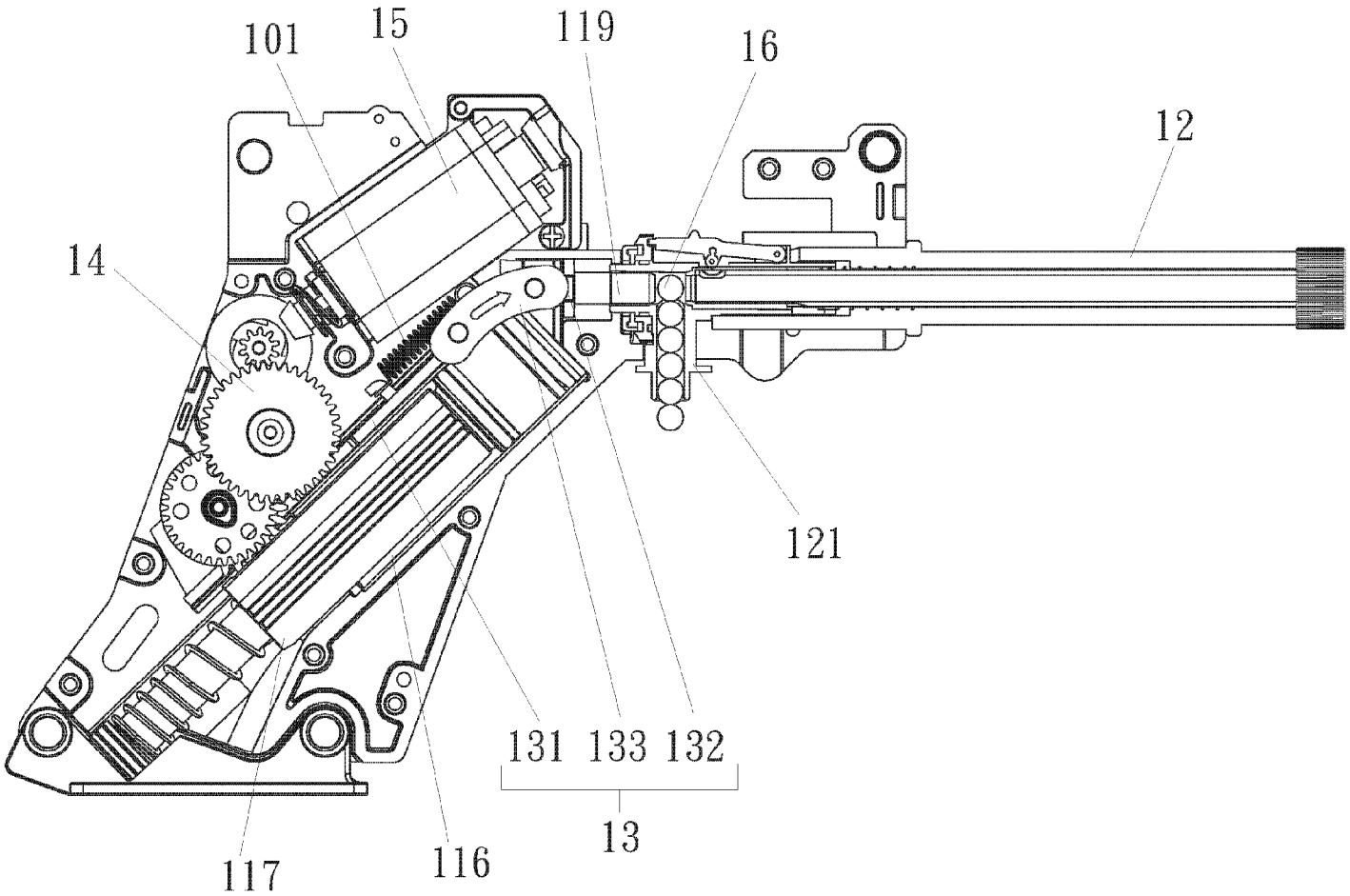
FIG. 3F is a perspective view of operation of the feeding linkage structure viewed from the delivering side thereof according to an embodiment of the present invention.
Figure 3G:
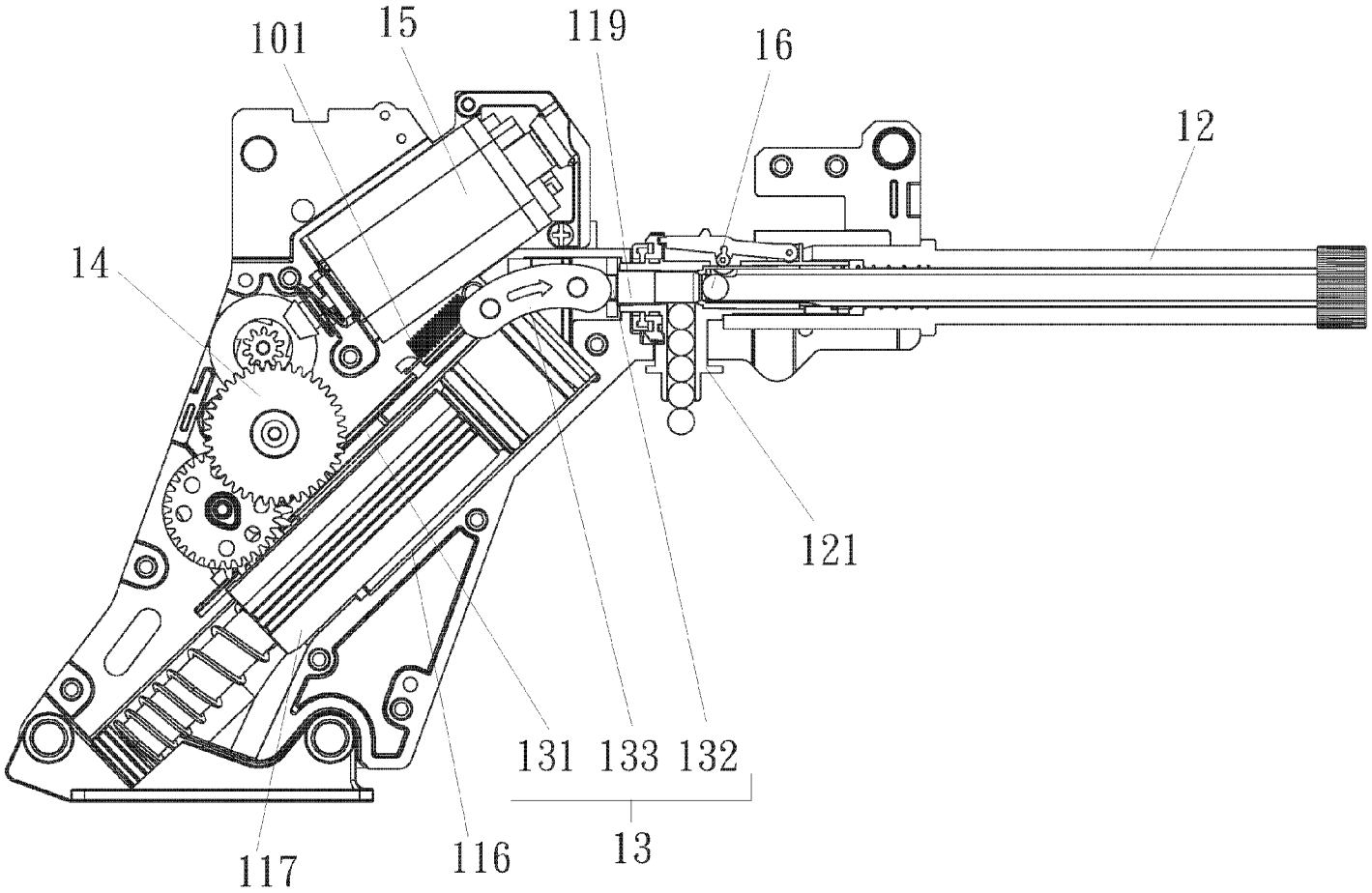
FIG. 3G is a perspective view of operation of the feeding linkage structure viewed from the ramming side thereof according to an embodiment of the present invention.

Referring to FIG. 3A, FIG. 3B and FIG. 3C, the quick-release-change spring structure of the present invention is disposed in the lower receiver 100. The lower receiver 100 has a gear train 14, a cylinder piston unit 11, an electric motor 15, and a barrel 12. The electric motor 15 is connected to the gear train 14. The gear train 14 is connected to a gear rack 118 on the outer wall of the cylinder piston unit 11. The electric motor 15 drives the cylinder piston unit 11 to operate. The cylinder piston unit 11 comprises a cylinder 116, a spring plate 111, a spring guide 112, a spring 113, and a piston 117. The spring plate 111 is connected to the spring guide 112. The spring guide 112 is a columnar structure for carrying the spring 113. The piston 117 is disposed in the cylinder 116, connected to the gear rack 118, and adapted to abut against the spring 113. The barrel 12 has a feeding component 121. The feeding component 121 is connected to a magazine (not shown) of the toy gun 1 and adapted to move a projectile from the magazine into the barrel 12.

According to the present invention, the cylinder piston unit 11 and the barrel 12 are connected by a nozzle (not shown), and an angle θ is defined between the cylinder piston unit 11 and the barrel 12, thereby allowing the spring plate 111 to connect with the bottom of the assembled electric toy gun 1 through a connecting element 114. The bottom of the lower receiver 100 is substantially parallel to the barrel 12.

In an embodiment of the present invention, the connecting element 114 is a pin structure, wherein an elastic element 115 is disposed at the tail of the pin structure and engaged with the lower receiver 100 of the assembled electric toy gun 1. With reference to the aforesaid structures, elements, and designs, the present invention provides applications and operations as described below. Referring to FIG. 3A, there is shown a structural schematic view of the toy gun quick-release-change spring structure according to an embodiment of the present invention. A user (not shown) only has to disconnect the connecting element 114 in order for the spring plate 111, the spring guide 112, and the spring 113 to be taken out and changed.

As mentioned before, a conventional electric toy gun alters projectile propulsion strength by altering the modulus of elasticity of its spring structure. However, it is difficult to dismount the spring structure of the conventional electric toy gun. Compared with its conventional counterpart, the toy gun quick-release-change spring structure of the present invention has advantages as follows: 1. the quick-release-change spring structure of the present invention allows a spring in the toy gun to be changed quickly; 2. the quick-release-change spring structure of the present invention effectively precludes excessive stockpiles; and 3. the quick-release-change spring structure of the present invention allows an elastic element to be disposed at the tail of the pin structure and engaged firmly with the receiver of the toy gun.

Referring to FIG. 3D through FIG. 3G, a feeding linkage structure of the present invention comprises a transmission kit 13. Since the gear train 14 comprises a sector gear 141 and a protruding portion 142, the sector gear 141 is connected to the gear rack 118. The cylinder piston unit 11 comprises a cylinder 116, a spring plate 111, a spring guide 112, a spring 113, and a piston 117. The spring plate 111 is connected to the spring guide 112. The spring guide 112 is a columnar structure for carrying the spring 113. The spring plate 111 is connected to the bottom of the toy gun 1 through a connecting element 114. In a preferred embodiment of the present invention, the connecting element 114 is a pin structure.

The piston 117 is disposed in the cylinder 116, connected to the gear rack 118, and adapted to abut against the spring 113. The barrel 12 comprises a nozzle 119 and a feeding component 121. The nozzle 119 is adapted to abut against a projectile 16. The feeding component 121 is connected to a magazine (not shown) of the assembled electric toy gun 1 to move the projectile 16 from the magazine to the barrel 12.

An angle θ is defined between the cylinder piston unit 11 and the barrel 12. The nozzle 119 is connected to the transmission kit 13. The transmission kit 13 and the cylinder piston unit 11 are interlocked by the gear train 14. The transmission kit 13 transmits an operating force to the nozzle 119 while the gear train 14 is operating such that not only is the projectile 16 pushed into the barrel 12, but the cylinder piston unit 11 also compresses air therein to propel the projectile 16. In a preferred embodiment of the present invention, the transmission kit 13 comprises a drawbar 131 and an interlocking portion 132. The gear train 14 drives the drawbar 131 to operate. The interlocking portion 132 has one end connected to the drawbar 131 through a link 133 and the other end connected to the nozzle 119 so that not only is the projectile 16 which the nozzle 119 abuts against pushed to the end of the barrel 12, but the cylinder piston unit 11 also compresses air therein, allowing the projectile 16 to be moved along the barrel 12 and eventually ejected.

With reference to the aforesaid structures, elements, and designs, the present invention provides applications and operations as described below. When the electric motor 15 drives the gear train 14 to rotate, the sector gear 141 gets connected to the gear rack 118 and thus drives the piston 117 to move in the axial direction toward the rear end of the cylinder piston unit 11 so that the space between the piston 117 and the cylinder 116 increases to thereby admit ambient air. The gear train 14 also drives, through the protruding portion 142, the drawbar 131 to move in the axial direction toward the rear end of the cylinder piston unit 11. Since the transmission kit 13 is connected to the nozzle 119, the nozzle 119 is driven by the protruding portion 142 to move backward within the barrel 12 and thus form a space for receiving the projectile 16. At this point in time, under the guidance provided by the feeding component 121, the projectile 16 elevates and thus moves from the magazine into the barrel 12.

Preferably, the lower receiver 100 further comprises a restoring spring 101. The restoring spring 101 is connected to the lower receiver 100 and the drawbar 131; hence, upon separation of the protruding portion 142 and the drawbar 131, the restoring spring 101 drives the drawbar 131 by elasticity so that the nozzle 119 moves the projectile 16 into the barrel 12. Then, the sector gear 141 is located at a gearless position and connected to the gear rack 118. The sector gear 141 is disengaged from the transmission involving the gear rack 118 so that the piston 117 gets free of the meshing and driving engagement with the sector gear 141. Under the elasticity of the spring 113, the piston 117 is driven to move toward the front end of the cylinder piston unit 11 and thus compress the air between the piston 117 and the cylinder 116. As a result, the compressed air moves along the nozzle (not shown) in the cylinder 116 before reaching the nozzle 119. The mouth (not shown) of the nozzle 119 is in communication with the nozzle so that the projectile 16 in the vicinity of the nozzle 119 is moved along the barrel 12 and eventually ejected. Compared with its conventional counterpart, the feeding linkage structure of the present invention is not only applicable to an electric toy gun with a cylinder piston unit and a barrel, which are aligned with different axial directions, but also prevents the cylinder piston unit in operation from undergoing energy loss which might otherwise compromise the propulsion speed of the projectile.

Figure 4A:
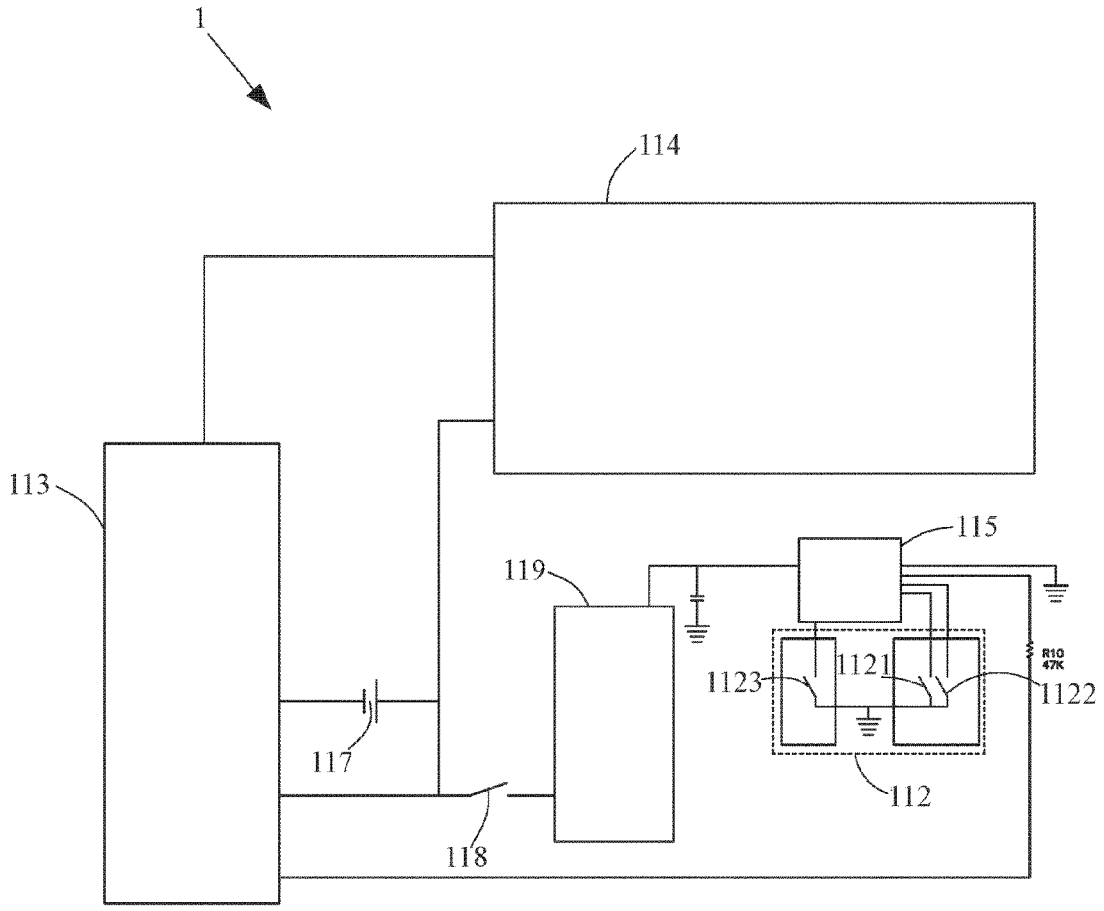
FIG. 4A is a circuit diagram of a firing mode system of the present invention.
Figure 4B:
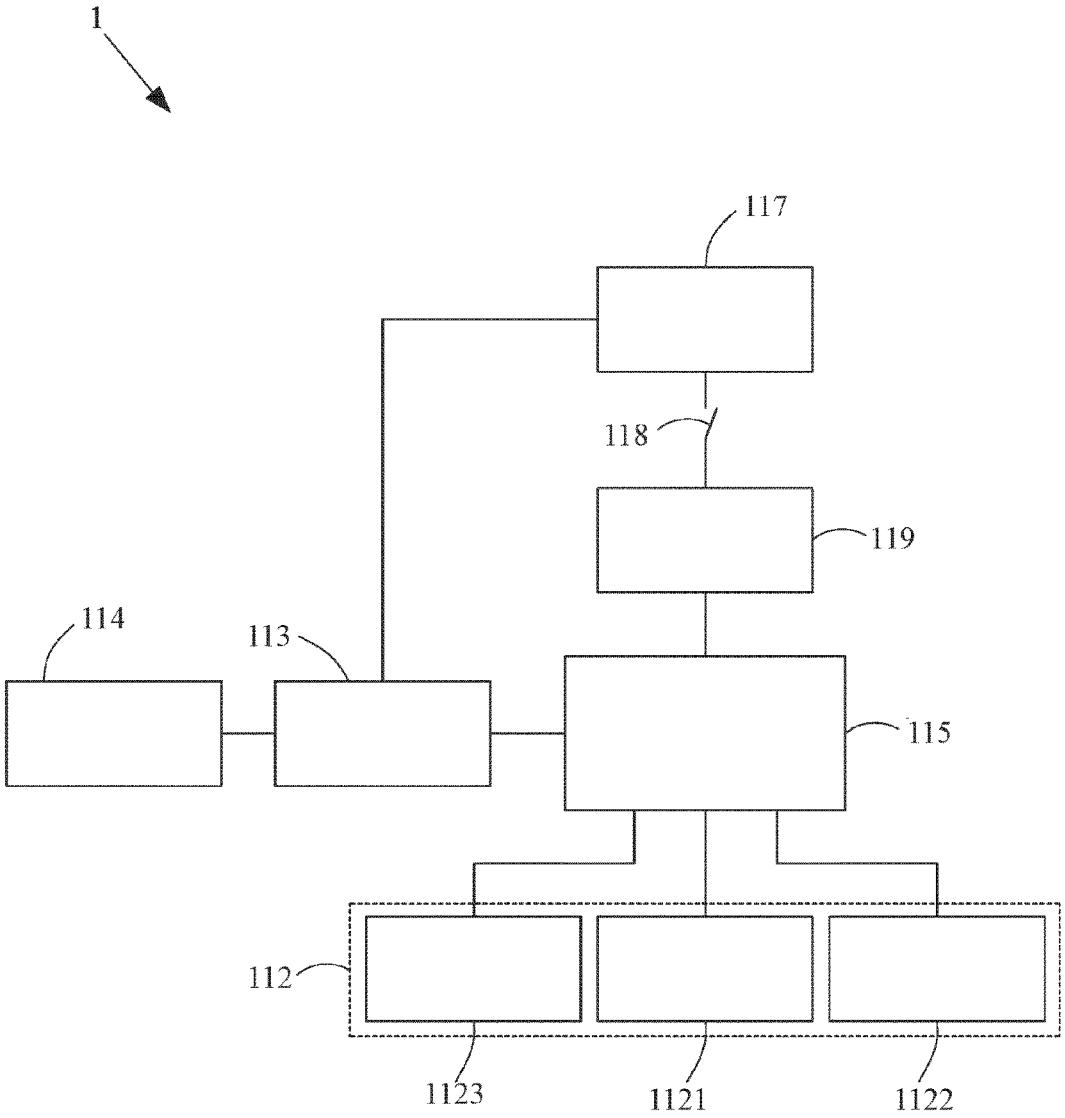
FIG. 4B is a schematic view of the framework of the firing mode system of the present invention.

Referring to FIG. 4A and FIG. 4B, there are shown a circuit diagram and a framework schematic view of a toy gun firing mode system of the present invention. A toy gun firing mode system 1 of the present invention comprises a battery 117, a trigger switch 118, a power converter 119, a micro control unit 115, a power switch module 113, a switch unit 112, and a motor gear piston unit 114. The motor gear piston unit 114 comprises the transmission kit 13, the gear train 14, the cylinder piston unit 11 and the electric motor 15. For illustrative sake, the motor gear piston unit 114 is described below. The battery 117 supplies a power. The power has an operating voltage of 12V or so and an operating current of 10-30 A. The trigger switch 118 is connected to the battery 117. The trigger switch 118 is in one of a contact operation state and a break suspension state. The power converter 119 is in electric signal connection with the trigger switch 118. The micro control unit 115 is in electric signal connection with the power converter 119. The micro control unit 115 is capable of sending a signal. The switch unit 112 is in electric signal connection with the micro control unit 115. The power switch module 113 is in electric signal connection with the trigger switch 118, the battery 117, and the micro control unit 115, respectively. The power switch module 113 is a metal-oxide-semiconductor field-effect transistor (MOSFET) and thus operates in a switch-on state and a switch-off state. The motor gear piston unit 114 is in electric signal connection with the battery 117 and the power switch module 113, respectively.

In a preferred embodiment of the present invention, when the trigger switch 118 is in the contact operation state, i.e., a firing state, both the battery 117 and the power converter 119 are in an electric signal-on state, thereby allowing the power converter 119 to receive the power from the battery 117. Furthermore, the battery 117 supplies the power with an operating voltage of 12V, and then the 12V operating voltage of the power is transformed by the power converter 119 to an operating voltage of the micro control unit 115. The micro control unit 115 has an operating voltage of 5V. The micro control unit 115 sends the signal to the power switch module 113; hence, the power switch module 113 is in the switch-on state so that the battery 117 supplies the power for driving the motor gear piston unit 114 to operate. Given the 12V operating voltage of the power and the 10-30 A operating current of the motor gear piston unit 114, the motor gear piston unit 114 uses directly the operating current of the power supplied by the battery 117. The power switch module 113 operates in conjunction with a rectification unit (not shown) to adjustably attain the operating current of the motor gear piston unit 114.

When the trigger switch 118 is in the break suspension state, i.e., a nonfiring state, the power converter 119 cannot receive the power supplied by the battery 117, neither can the micro control unit 115 send the signal to the power switch module 113, thereby causing the power switch module 113 to stay in the switch-off state and preventing the battery 117 from supplying the power to the motor gear piston unit 114. Hence, when the trigger switch 118 of the toy gun firing mode system 1 of the present invention is in the break suspension state, i.e., a nonfiring state, the micro control unit 115 is not operating, thereby saving the power of the toy gun effectively.

Figure 4C:
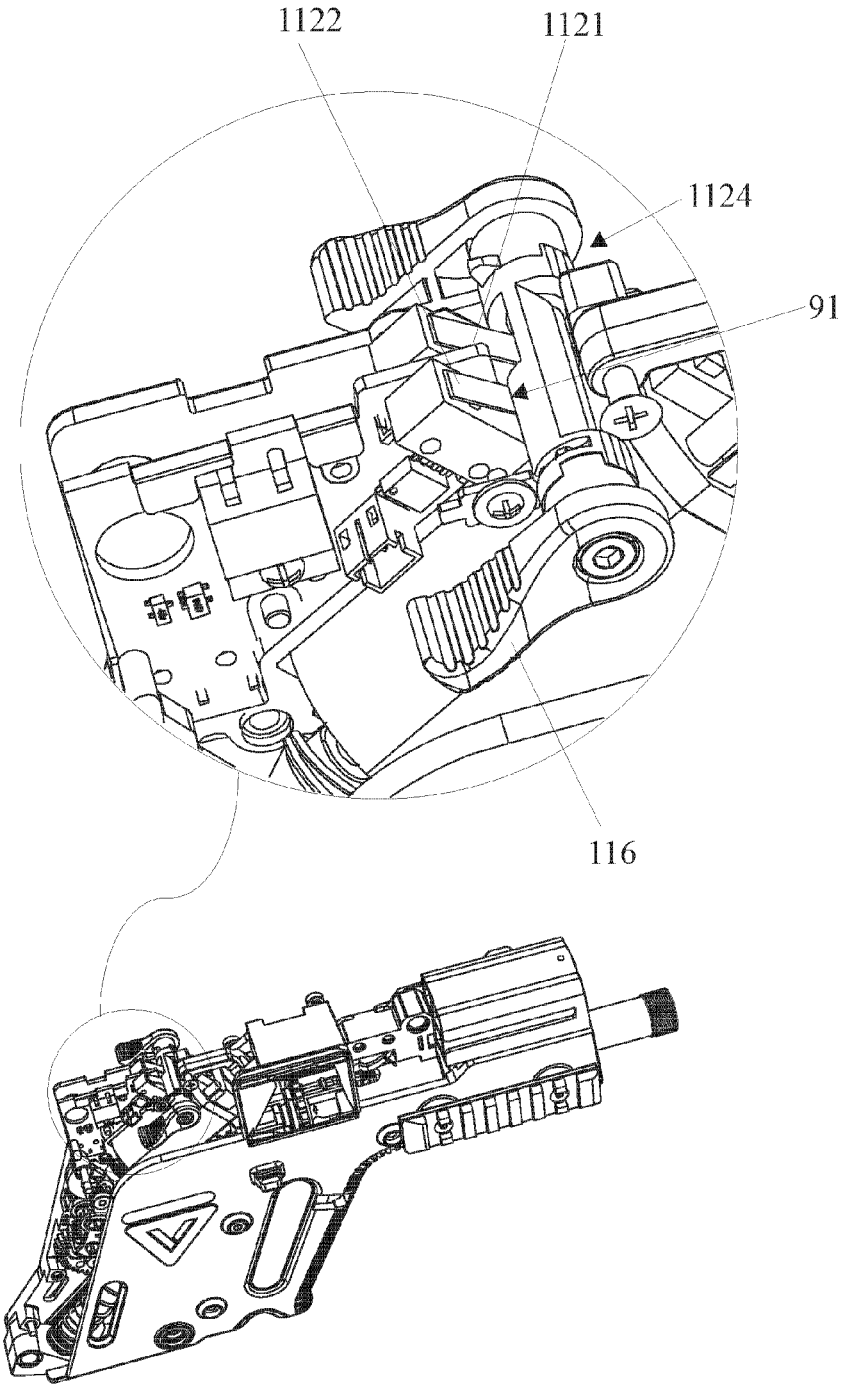
FIG. 4C is a schematic view of the firing mode system operating in a single shot mode according to the present invention.
Figure 4D:
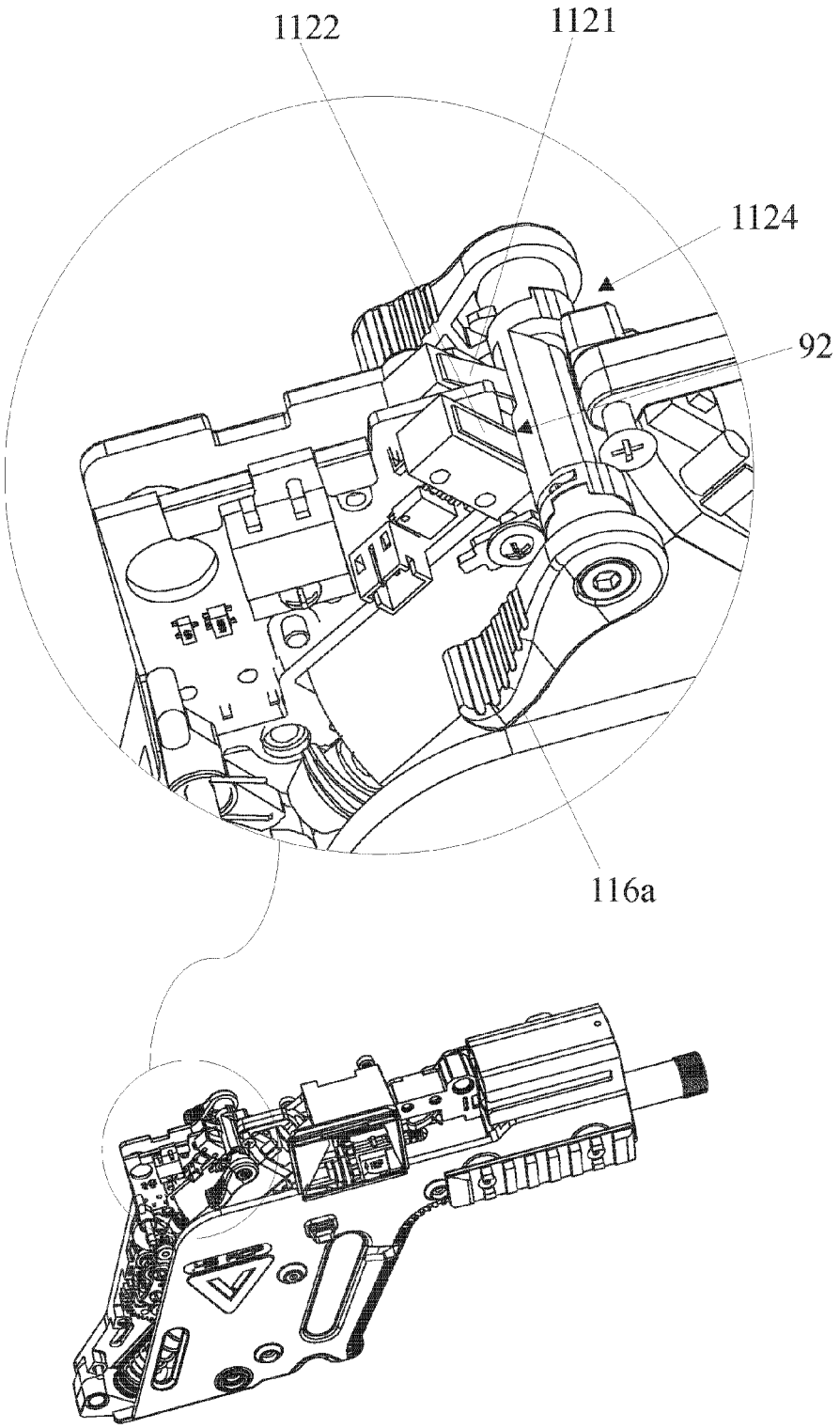
FIG. 4D is a schematic view of the firing mode system operating in a double shot mode according to the present invention.
Figure 4E:
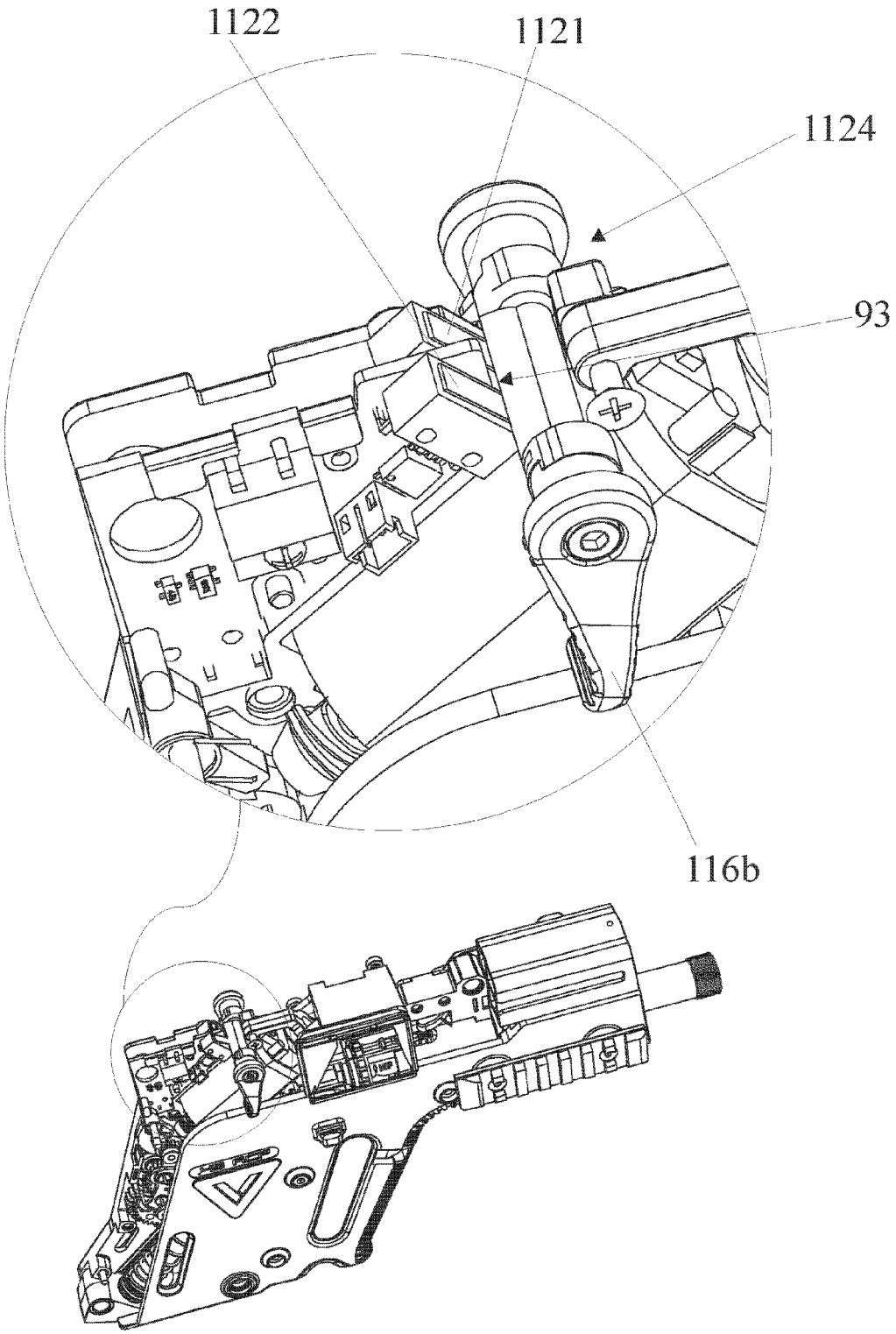
FIG. 4E is a schematic view of the firing mode system operating in a multi-shot mode according to the present invention.

Referring to FIG. 4C through FIG. 4E, there are shown schematic views of the firing mode system of the present invention in a single shot mode, a double shot mode, and a multi-shot mode. According to the present invention, the switch unit 112 has a first switch 1121, a second switch 1122, a cam disk 1124, and a lever 116. The first switch 1121 has one end connected to the micro control unit 115 and the other end grounded. The second switch 1122 has one end connected to the micro control unit 115 and the other end grounded. The cam disk 1124 is positioned proximate to the first switch 1121 and the second switch 1122. The cam disk 1124 is located at a first contact position 91, a second contact position 92 or a third contact position 93. The first contact position 91 requires the cam disk 1124 to separate from the first switch 1121 and the second switch 1122. The second contact position 92 requires the cam disk 1124 to separate from the first switch 1121 and press against the second switch 1122. The third contact position 93 requires the cam disk 1124 to press against the first switch 1121 and the second switch 1122. The levers 116, 116*a*, 116*b* are connected to a shaft of the cam disk 1124. The levers 116, 116*a*, 116*b* are mounted to the cam disk 1124 with screws to drive the cam disk 1124 to rotate such that the cam disk 1124 is switched among the first contact position 91, the second contact position 92, and the third contact position 93.

Referring to FIG. 4A and FIG. 4B, the switch unit 112 further has a cut-off switch 1123. The cut-off switch 1123 has one end connected to the micro control unit 115 and the other end grounded. The cut-off switch 1123 detects the count of the finished operations of the motor gear piston unit 114. In a preferred embodiment of the present invention, when the cam disk 1124 is located at the first contact position 91, and the trigger switch 118 in the contact operation state, i.e., a firing state, the micro control unit 115 starts and receives a signal from the first switch 1121 and the second switch 1122 simultaneously, whereas the cam disk 1124 separates from the first switch 1121 and the second switch 1122, with the micro control unit 115 set to a single shot mode, thereby allowing the micro control unit 115 to send the signal to the power switch module 113. At this point in time, the power switch module 113 is in the switch-on state and thus drives the motor gear piston unit 114 to operate. After the motor gear piston unit 114 has finished one instance of operation, the cut-off switch 1123 sends a signal to the micro control unit 115 once; meanwhile, the micro control unit 115 intercepts the signal sent to the power switch module 113 so that the power switch module 113 is in the switch-off state, thereby allowing a single shot mode to require the motor gear piston unit 114 to finish only one instance of operation.

When the cam disk 1124 is located at the second contact position 92, and the trigger switch 118 in the contact operation state, i.e., a firing state, the micro control unit 115 starts and receives a signal from the first switch 1121 and the second switch 1122 simultaneously, whereas the cam disk 1124 separates from the first switch 1121 and presses against the second switch 1122, with the micro control unit 115 set to a double shot mode, thereby allowing the micro control unit 115 to send the signal to the power switch module 113. At this point in time, the power switch module 113 is in the switch-on state and thus drives the motor gear piston unit 114 to operate. After the motor gear piston unit 114 has finished two instances of operation, the cut-off switch 1123 sends a signal to the micro control unit 115 twice; meanwhile, the micro control unit 115 intercepts the signal sent to the power switch module 113 so that the power switch module 113 is in the switch-off state, thereby allowing a double shot mode to require the motor gear piston unit 114 to finish only two instances of operation.

When the cam disk 1124 is located at the third contact position 93, and the trigger switch 118 in the contact operation state, i.e., a firing state, the micro control unit 115 starts and receives a signal from the first switch 1121 and the second switch 1122 simultaneously, whereas the cam disk 1124 presses against the first switch 1121 and the second switch 1122, with the micro control unit 115 set to a multi-shot mode, thereby allowing the micro control unit 115 to send the signal to the power switch module 113. At this point in time, the micro control unit 115 ignores the signal sent from the detecting switch 1123 but continuously sends the signal to the power switch module 113, and thus the motor gear piston unit 114 operates continuously until the trigger switch 118 enters the break suspension state, i.e., a nonfiring state, to suspend the operation of the micro control unit 115 and cause the power switch module 113 to enter the switch-off state, thereby allowing a multi-shot mode to require the motor gear piston unit 114 to operate continuously.

According to the present invention, the trigger switch 118 becomes in electric signal connection with the power converter 119 and then in electric signal connection with the micro control unit 115; hence, when the trigger switch 118 is in the break suspension state, i.e., a nonfiring state, the micro control unit 115 is not operating, thereby saving the power of the toy gun. In addition, the aforesaid structures and features of the present invention cannot be easily conceived and accomplished by persons skilled in the art and thus has novelty and non-obviousness.

The above description sufficiently shows that the objective and advantages of the present invention are novel and non-obvious and have high industrial applicability and thus meet legal requirements of invention patentability. Although the present invention is disclosed above by preferred embodiments, the preferred embodiments are not restrictive of the scope of the implementation of the present invention. All equivalent changes and modifications made to the preferred embodiments according to the claims of the present invention should fall within the scope of the claims of the present invention.

What is claimed is:

1. An assembled electric toy gun, comprising:

an upper receiver having a battery and at least one posting unit, with the battery disposed in the upper receiver to supply a power, and the at least one posting unit each being a hollow-cored post, disposed in the upper receiver, and being of a height;

a lower receiver having a motor, a barrel, a cylinder piston unit, and a quick-release-change spring structure, with the lower receiver connected to the upper receiver, the motor disposed in the lower receiver, the barrel disposed in the lower receiver, wherein an angle is defined between the cylinder piston unit and the barrel, and the quick-release-change spring structure is connected to a bottom of the lower receiver through a connecting element;

a power module, further comprising:

a first printed circuit board (PCB) electrically connected to the battery and including at least one mounting hole of an inner diameter larger than an outer diameter of the at least one posting unit, with the first PCB being of a thickness smaller than the height of the at least one posting unit, the at least one mounting hole fitting around the at least one posting unit, respectively, a screw penetratingly disposed through an inner wall of the at least one posting unit, thereby allowing the first PCB to be mounted inside the upper receiver, wherein at least two terminal clips are disposed on the first PCB; and a second PCB electrically connected to the motor and including at least two terminals disposed on the lower receiver, with the terminals clamped by the at least two terminal clips on the first PCB when the lower receiver is connected to the upper receiver, thereby allowing the second PCB to be electrically connected to the first PCB;

a feeding linkage structure with a nozzle abutting against a projectile and connecting with a transmission kit, wherein the transmission kit and the cylinder piston unit are interlocked by a gear train;

a firing mode system disposed in the lower receiver and connected to the battery through a trigger switch being in one of a contact operation state and a break suspension state.

2. The assembled electric toy gun of claim 1, wherein the at least one posting unit is a hollow-cored post, and an internal thread is disposed on an inner wall of the post.

3. The assembled electric toy gun of claim 1, wherein the upper receiver and the at least one posting unit are integrally formed.

4. The assembled electric toy gun of claim 1, wherein the at least one posting unit is disposed on a base connected to the upper receiver.

5. The assembled electric toy gun of claim 1, wherein the cylinder piston unit comprises a spring plate and a spring guide, with the spring guide connected to the spring plate and adapted to carry a spring, wherein an angle is defined between the cylinder piston unit and the barrel, thereby allowing the spring plate to connect with a bottom of the assembled electric toy gun through a connecting element.

6. The assembled electric toy gun of claim 5, wherein the spring guide is a columnar structure.

7. The assembled electric toy gun of claim 1, wherein the transmission kit transmits an operating force to the nozzle while the gear train is operating such that, under motion of the nozzle, not only is the projectile pushed into the barrel, but the cylinder piston unit also compresses air therein to propel the projectile.

8. The assembled electric toy gun of claim 1, wherein the transmission kit comprises:

a drawbar connected to the gear train; and an interlocking portion with an end connected to the drawbar through a link and another end connected to the nozzle to drive the nozzle to move.

9. The assembled electric toy gun of claim 8, wherein the assembled electric toy gun further comprises a restoring spring connected to the drawbar and adapted to drive the transmission kit to move by elasticity so that the nozzle moves the projectile into the barrel.

10. The assembled electric toy gun of claim 1, wherein the motor is an electric motor and is in electric signal connection with the gear train, thereby allowing the gear train to drive the transmission kit and the cylinder piston unit to operate.

11. The assembled electric toy gun of claim 1, wherein the cylinder piston unit comprises:

a cylinder;

a piston disposed in the cylinder;

a spring for abutting against the piston;

a spring guide for carrying the spring; and a spring plate connected to the spring guide.

12. The assembled electric toy gun of claim 11, wherein the spring plate is connected to a bottom of the assembled electric toy gun through a connecting element, with the connecting element being a pin structure.

13. The assembled electric toy gun of claim 12, wherein an elastic element is disposed at a tail of the pin structure and engaged with the lower receiver.

14. The assembled electric toy gun of claim 1, wherein the firing mode system comprises:

a power converter in electric signal connection with the trigger switch;

a micro control unit in electric signal connection with the power converter, with the micro control unit being capable of sending a signal;

a power switch module in electric signal connection with the trigger switch, the battery, and the micro control unit, respectively, with the power switch module being in one of a switch-on state and a switch-off state; and a motor gear piston unit in electric signal connection with the battery and the power switch module, respectively, wherein, when the trigger switch is in the contact operation state, the power converter receives the power from the battery and transforms the power to an operating voltage of the micro control unit to enable the micro control unit to send the signal to the power switch module, allow the power switch module to be in the switch-on state, and cause the battery to supply the power required for operating the motor gear piston unit.

15. The assembled electric toy gun of claim 14, wherein, when the trigger switch is in the break suspension state, the power converter cannot receive the power supplied by the battery, and neither can the micro control unit send the signal to the power switch module, so as to allow the power switch module to be in the switch-off state and prevent the battery from supplying the power to the motor gear piston unit.

16. The assembled electric toy gun of claim 14, wherein the toy gun firing mode system further comprises a switch unit in electric signal connection with the micro control unit, the switch unit comprising:

a first switch with an end connected to the micro control unit and another end grounded;

a second switch with an end connected to the micro control unit and another end grounded; and a cam disk positioned proximate to the first switch and the second switch and located at one of a first contact position, a second contact position, and a third contact position, with the first contact position requiring the cam disk to separate from the first switch and the second switch, the second contact position requiring the cam disk to separate from the first switch and press against the second switch, and the third contact position requiring the cam disk to press against the first switch and the second switch.

17. The assembled electric toy gun of claim 16, wherein the switch unit further has a lever connected to a shaft of the cam disk to drive the cam disk to rotate such that the cam disk is switched among the first contact position, the second contact position, and the third contact position.

18. The assembled electric toy gun of claim 17, wherein the lever and the cam disk are integrally formed.

19. The assembled electric toy gun of claim 16, wherein the cam disk is located at the first contact position to put the motor gear piston unit in a single shot mode in which the motor gear piston unit finishes one instance of operation, located at the second contact position to put the motor gear piston unit in a double shot mode in which the motor gear piston unit finishes two instances of operation, and located at the third contact position to put the motor gear piston unit in a multi-shot mode in which the motor gear piston unit operates continually.

20. The assembled electric toy gun of claim 16, wherein the switch unit further has a cut-off switch with an end connected to the micro control unit and another end grounded, and the cut-off switch detects a count of the finished operations of the motor gear piston unit.

* * * * *